United States Patent [19]

Larson

[11] 3,947,052

[45] Mar. 30, 1976

[54] SKI BINDING

[75] Inventor: Richard A. Larson, Boulder, Colo.

[73] Assignee: Hanson Industries Inc., Boulder, Colo.

[22] Filed: Nov. 6, 1974

[21] Appl. No.: 521,392

Related U.S. Application Data

[63] Continuation-in-part of Ser. No. 275,449, July 28, 1972, abandoned.

[52] U.S. Cl. ..... 280/11.35 K; 280/11.35 D; 280/11.35 N

[51] Int. Cl.[2] ..... A63C 9/086

[58] Field of Search ..... 280/11.35 D, 11.35 M, 11.35 R, 280/11.35 C, 11.35 K, 11.35 N, 11.35 T, 11.35 Y

[56] References Cited

UNITED STATES PATENTS

| | | | |
|---|---|---|---|
| 2,364,620 | 12/1944 | Crocker et al. | 280/11.35 R |
| 3,764,154 | 10/1973 | Witting | 280/11.35 N |
| 3,801,119 | 4/1974 | Andre | 280/11.35 K |
| 3,806,144 | 4/1974 | Yans | 280/11.35 C |
| 3,825,273 | 7/1974 | Greene | 280/11.35 K |
| 3,834,723 | 9/1974 | Erlebach | 280/11.35 D |
| 3,854,740 | 12/1974 | Gertsch et al. | 280/11.35 R |

*Primary Examiner*—M. H. Wood, Jr.
*Assistant Examiner*—David M. Mitchell
*Attorney, Agent, or Firm*—Merriam, Marshall, Shapiro & Klose

[57] ABSTRACT

An improved ski binding which permits lateral release at heel and toe only in a direction toward the inside edge of the ski, while preventing lateral release to the outside edge of the ski. A preferred embodiment provides a plate type of binding biased by an extensible leash against a pair of longitudinally spaced pivot points about either of which the plate can rotate to permit release only toward the inside of the ski.

15 Claims, 12 Drawing Figures

10
11
12
13
14
16
17
18
19
22
23
24
31
38
39
41
42
43
44
45
46
51

SKI BINDING

This application is a continuation-in-part of my copending application, Ser. No. 275,449, filed July 28, 1972, and now abandoned, the disclosure of which is expressly incorporated herein by reference.

BACKGROUND

This invention relates to an improved safety ski binding for detachably holding a ski boot on a ski, and more particularly to a binding which discriminates in operation between forces applied to the lateral outside edge of a ski, and forces applied to the lateral inner edge of the ski. Still more particularly, the invention relates to a ski binding of the plate type which is self-restoring after release and which offers improved retention of the ski to the boot under certain commonly encountered skiing conditions which have heretofore tended to cause unwanted release of the bindings, while retaining a high or significant safety margin under conditions which present a risk of serious injury to the skier.

It is conventional in the sport of snow skiing to use a safety binding for attaching the boot of the skier to the top surface of the ski. The binding is generally intended to prevent serious injury to the skier by releasing the boot from the ski when the forces applied to the ski are of such a nature or magnitude as to cause a dangerous torque or other force to be applied to the skier's leg. Although the use of such safety bindings has reduced the incidence of serious injuries to skiers, many skiers continue to be injured even while wearing such safety bindings, because of deficiencies inherent in the design or the operation of the binding under commonly encountered skiing conditions.

In safety ski bindings heretofore known, it has generally been considered desirable to provide a mechanism which releases when a lateral force of a defined magnitude (adjustable by the skier) is applied to the binding, regardless of the side (i.e., inner or outer) of the ski to which the force is applied. Such bindings are generally symmetrical in their operation about the longitudinal axis of the ski, so that if a force of a given magnitude applied transversely to the side of a ski at a given location along its length causes the binding mechanism to release, the same force applied in the opposite direction to the corresponding location on the opposite side of the ski will also cause the binding to release. Further, in some bindings the same mode of release is used at the toe and the heel portions of the boot, making the operation of the binding symmetrical about a transverse axis through the boot, i.e., if a transverse force applied to the ski at a given distance forward of the boot will cause the binding to release, the same force at the corresponding distance rearward of the boot will also cause the binding to release, regardless of whether the force is applied to the inside edge or the outside edge of the ski.

While it was originally believed that a safety ski binding providing the greatest possible number of modes of release, e.g., lateral release, both inwardly and outwardly at the heel and toe of the boot, roll release at both heel and toe, vertical release at heel and toe, and thrust release at heel and toe, would provide the greatest protection for the skier, this has not proved to be true in actuality. During many skiing maneuvers, particularly by an advanced or expert skier, there are at times produced substantial lateral forces on the ski, which forces are nevertheless well within the safety margin necessary for the protection of the skier and entirely within his control. Under such circumstances, some of the prior art bindings have a tendency to release unexpectedly, since the force tending to separate the boot and the ski exceeds the force necessary for releasing the binding, even though there is no imminent danger to the skier. The unexpected release of the bindings in this manner can cause the skier to fall and thus suffer injuries which the bindings are intended to prevent. Moreover, the tendency of a skier who experiences an unexpected release during a controlled maneuver is to tighten the release setting of his bindings so as to avoid a recurrence. Tightening the bindings, however, reduces the margin of safety which the bindings were intended to provide when a dangerous situation exists.

For example, a binding providing both inward and outward lateral release at both toe and heel will release, as it should, if the skier catches a tip of his skis in an obstruction, causing a large twisting movement or torque to be applied to his leg. This type of binding, however, may also release unexpectedly during a controlled maneuver, such as a sideslip, which imparts a transverse force to both the toe and the heel on the same side of the boot and thus produces little or no torque or other dangerous force. If a binding of this type, however, is tightened sufficiently to prevent such an unexpected and unwanted release, it may fail to operate reliably when necessary to protect the skier in a truly dangerous situation.

SUMMARY OF THE INVENTION

In accordance with the invention, there is provided a novel and improved ski binding which discriminates between and has a different response to forces applied to the outer and inner edges of the skis. In this connection, it should be understood that "inner" and "outer" edges are used to refer to the ski edges beneath the inner and outer surfaces, respectively, of the skier's ankle. The inner edges of the skis are adjacent each other during parallel skiing.

The release modes of the safety binding of the invention permit individual and simultaneous inward lateral release of both the toe and heel of the boot, and individual and simultaneous vertical release of both heel and toe. Outward lateral release of heel or toe, whether individual or simultaneous, however, is not possible. This combination of release modes provides maximum safety for the skier with respect to forces applied to the inside of the ski, while also providing maximum retention in response to forces applied to the outside of the ski, in the vicinity of the skier's boot, the latter being usually responsible for unexpected and unwanted release.

In addition to an improved combination of safety and retention, the binding of the invention provides a selfrestoring function which returns the skier's boot to operative position on the binding after an upsetting force which has caused the binding to release has been removed. Thus, after a fall which may have caused one or both bindings to release, the skier has only to position himself suitably to permit the bindings to draw his boots into operative position on the skis, thus eliminating the often difficult procedure of trying to insert a boot into a conventional binding while standing on a steep slope.

The binding of the invention is of the plate type, i.e., it employs a sole plate to which the boot is secured, rather than the heretofore conventional individual bindings used to connect separately the toe and heel of the boot to the ski. When release of the binding occurs, the entire sole plate leaves its normal position on the ski; the binding, however, remains attached to the boot. During normal operation of the binding, i.e., in the absence of abnormal or dangerous forces, the sole plate is resiliently held in place in alignment with a base plate attached to the ski. The force used to hold the sole plate in position is exerted by a single tensioned, extensible cable operatively connected between the sole plate and the base plate. The base plate and the sole plate are normally urged into contact by the tensioned cable, the contact occurring in part in two longitudinally displaced zones, the areas of mutual contact in said zones acting as vertical pivot axes about which limited relative rotation can occur, producing the modes of release previously described. Vertical separation of the base plate and sole plate can also occur in response to a force sufficient to overcome the bias of the tensioned cable.

The tensioning means used to produce tension in the extensible cable is so designed that on the application of a displacing force greater than a preset value, the cable will extend to permit relative motion of the sole plate and base plate in response to the displacing force. The tension produced in the cable by the tensioning decreases in magnitude as the amount of extension increases. Even at the maximum extension of the cable, however, a restoring force is still exerted by the cable, so that on removal of the displacing force, the cable serves to return the boot to a normal operating position on the ski.

DESCRIPTION OF THE DRAWINGS

The invention will be better understood from the following detailed description thereof, taken with the accompanying drawings, in which.

DETAILED DESCRIPTION

In contrast to conventional ski bindings which can be placed indiscriminately on either ski of a pair, the bindings of the invention are not interchangeable. The embodiments illustrated and described herein are designed for the left ski. It should be understood that the right ski binding is a mirror image of that shown and described and operates in a corresponding fashion.

Figures 1, 2, 3:
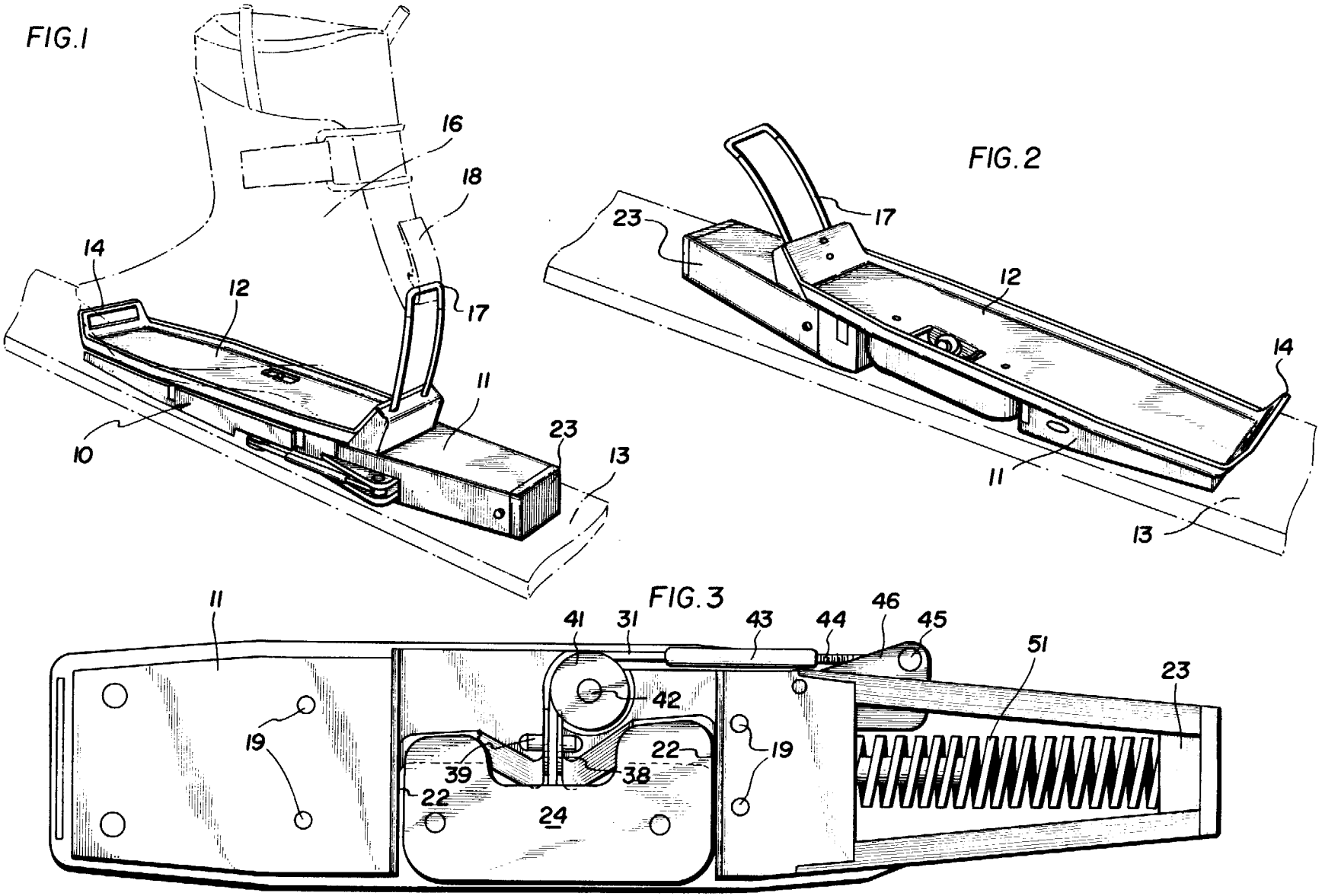
FIG. 1 is an isometric view of one embodiment of the safety binding of the invention in place on the top surface of a section of a ski, with a boot held in position by the binding shown in phantom outline.
FIG. 2 is an isometric view of the other side of the binding shown in FIG. 1.
FIG. 3 is a bottom view of the binding shown in FIG. 1, with the ski removed.
Figure 4:
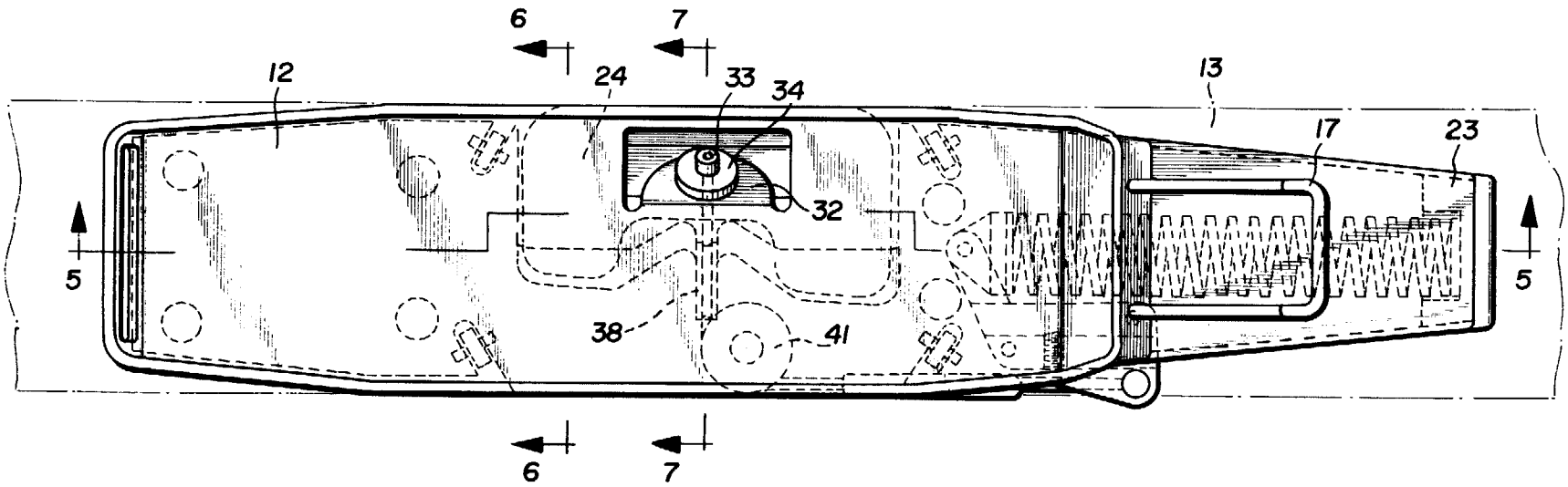
FIG. 4 is a top view of the binding of FIG. 1 in position on a ski.
Figure 5:
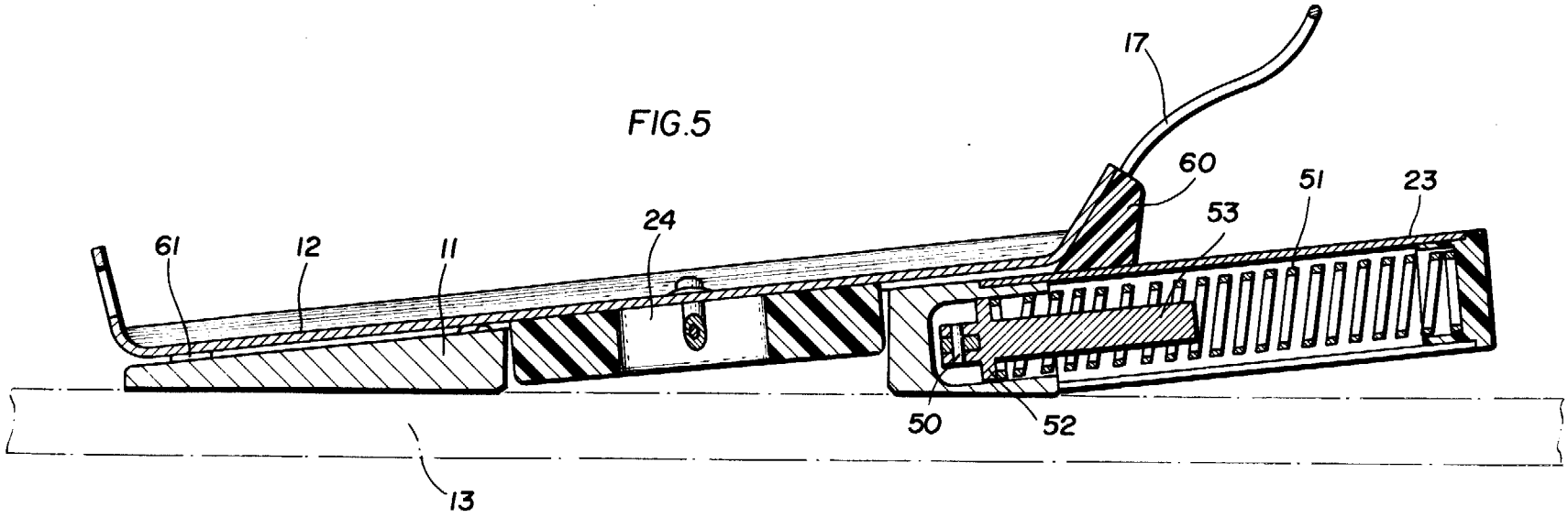
FIG. 5 is a sectional view along the line 5—5 of FIG. 4.

As shown in the drawings and particularly in FIGS. 1 and 2, the binding 10 of the invention comprises two portions, an elongated base plate 11 attached to the top surface of and in alignment with a ski 13 and an elongated sole plate 12 resiliently held on the top surface of the base plate and in alignment therewith. Sole plate 12 is provided at its forward (toe) end with means such as a bracket 14 shown for engaging a lug in the toe of a ski boot 16 and holding it in position thereon. The rear end of sole plate 12 is similarly provided with suitable means for attaching thereto the heel of the ski boot. In the embodiment shown, the rear attaching means comprises a flexible U-shaped cable 17, which engages a clamp 18 on the heel of the boot in a known manner to attach the boot heel firmly to the sole plate. It will be apparent that any other suitable means for attaching the boot to sole plate 12 can also be used.

Under normal skiing conditions and in the absence of any force tending to produce a torque or other dangerous force on a skier's leg, sole plate 12 remains in the position shown in FIGS. 1 and 2, i.e., held on top of and in alignment with base plate 11 with sufficient rigidity to permit the skier to control and direct his skis in the usual manner. If, however, there is applied to a ski a force which tends to create a dangerous condition relative to the skier's leg, sole plate 12 will move relative to base plate 11, in a direction and a manner hereinafter to be described in detail, in order to relieve the applied force and prevent injury.

The binding of the invention is so constructed that under the application of an appropriate force, the toe of sole plate 12 will move inwardly, i.e., in a direction toward the other ski of the pair, but not outwardly. The heel of sole plate 12 will similarly move inwardly but not outwardly. In another mode of release, both the heel and the toe of the sole plate can move simultaneously inwardly, but simultaneous outward movement of the sole and heel is not possible. In still another mode of release, the heel or the toe of the sole plate, or both, can move upwardly away from contact with the base plate, in response to forces tending to produce such movement.

Figure 8:
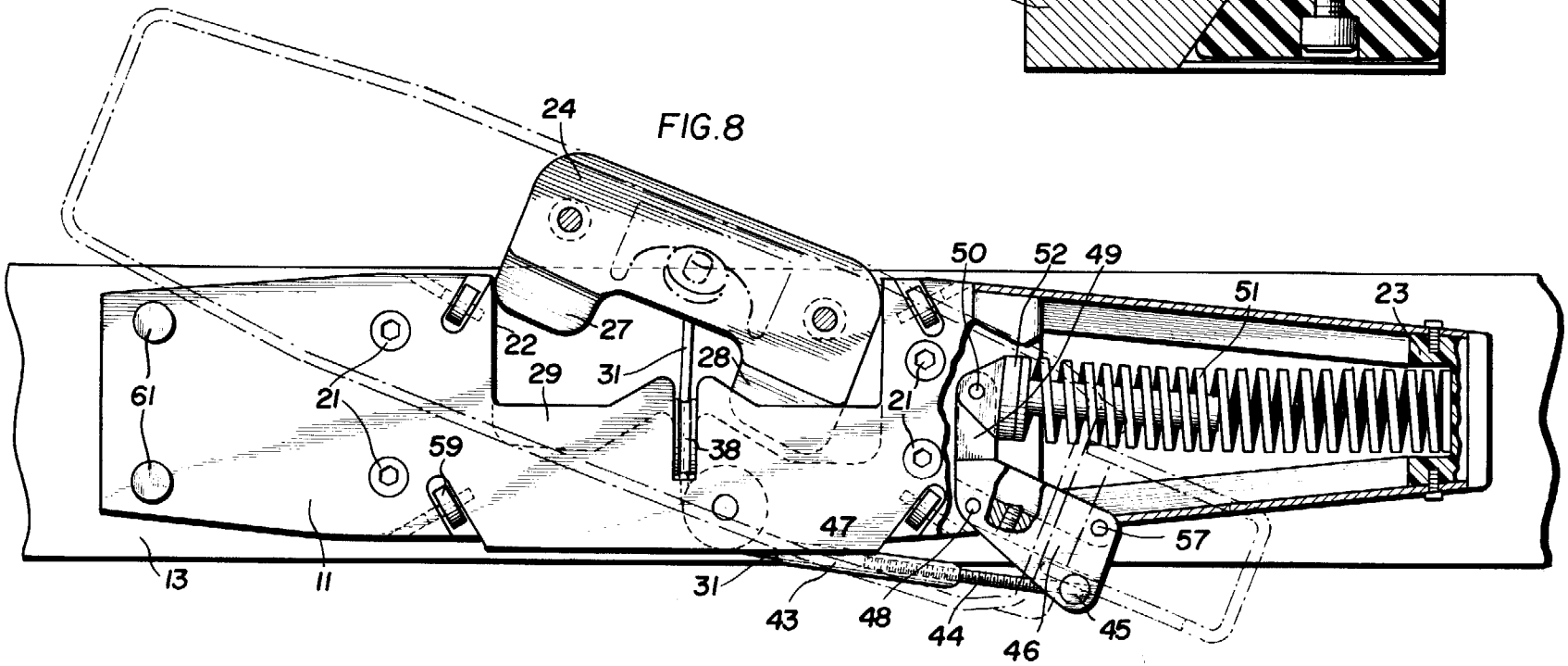
FIG. 8 is a top view of the binding of FIG. 4 with the sole plate rotated to illustrate partial inward release at the toe of the sole plate.

Base plate 11 is provided with mounting holes 19, through which the base plate is attached to the top surface of ski 13 in conventional fashion with screws 21 (FIG. 8). In a preferred embodiment, shown in the drawings, the thickness of base plate 11 varies from a maximum at the rear to a minimum at the front, thus providing a built-in forward lean to boot 16 attached thereto (FIG. 2). Because of the forward lean provided by such binding, a boot used in conjunction therewith need not have an elevated heel, commonly used for this purpose, but only a flat sole, which facilitates walking by the skier when not wearing the skis.

Along the outer lateral edge of base plate 11 and in a position approximately beneath the leg of the skier, base plate 11 is provided with a lateral recess 22, the length of which is generally suitably about 20 to 80 percent of the length of sole plate 12 used in conjunction therewith. Attached to the rear end base plate 11 is a housing 23 enclosing a spring used for tensioning the release mechanism of the binding and adjustment means for selectively regulating the force necessary to produce release of the binding, in a manner to be described.

Attached to the under surface of sole plate 12 is an elongated approximately rectangular pivot block 24 (FIG. 9) of a size and configuration which permits it to nest within but rotate out of lateral recess 22 in base plate 11. In the particular embodiment shown, block 24 is a separate unit attached to sole plate 12 by means of bolts 26, although it can also be made as a unitary part of the sole plate. Block 24 has two generally vertical bearing surfaces 27 and 28, which are longitudinally displaced and adapted to bear against the longitudinal face or edge 29 of recess 22 in base plate 11. The areas or zones of contact between block 24 and recess 22 constitute two generally vertical pivotal axes about which block 24 and sole plate 12 attached thereto can pivot relative to base plate 11 on the application of a suitable force.

Block 24 is normally urged into contact with the face 29 of recess 22 by means of a tensioned flexible cable 31, one end of which is connected to depending lip 32 formed in sole plate 12, and by means of thrust button 33 permanently attached to the end thereof, washer 34, and insert 36 used to prevent chafing of cable 31 against the edges of hole 37 in lip 32 through which the cable passes.

Figure 7:
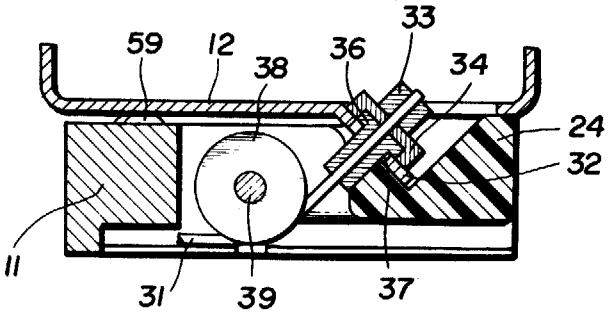
FIG. 7 is a sectional view along the line 7—7 of FIG. 4.

As shown in FIGS. 3, 7, and 8, cable 31 is extended about first pulley 38, which is arranged to rotate about a horizontal axis (pin 39) parallel to the longitudinal axis of base plate 11, and second pulley 41 which rotates about a vertical axis provided by pin 42. Cable 31 is pivotally attached by threaded adjustment sleeve 43, threaded rod 44 and pivot pin 45 to first arm 46 of bell crank 47, through which an adjustable predetermined tension is created in the cable. Tension in cable 31 is transmitted to sole plate 12 in a direction which is transverse to the longitudinal axis of the binding and at an acute angle with respect to the top of the ski, causing block 24 to bear against the longitudinal face 29 of recess 22 in base plate 11.

Figure 11:
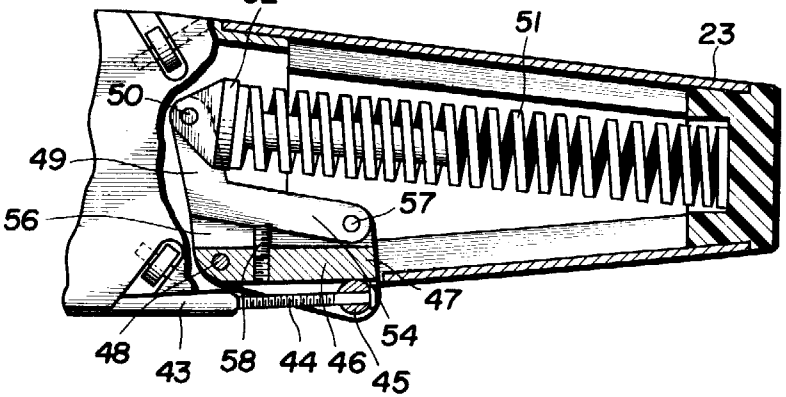
FIG. 11 is a sectional view along the line 11—11 of FIG. 9, showing means for adjusting the release tension; and, FIG. 12 is an illustrative graph of release curves showing the location, direction, and relative magnitude of lateral forces along the ski which will produce release of the binding, and the consequent torque on the skier's leg.

Bell crank 47 is pivoted for rotation about vertical pin 48 (FIG. 8 and 11). First arm 46 of bell crank 47 is connected as previously described to cable 31, while second arm 49 of the bell crank is operatively connected with one end of coil spring 51, the other end of the spring being affixed to the end of spring housing 23. The connection of spring 51 to second arm 49 of bell crank 47 is made by means of a connecting element 52, pivoted about pin 50 and provided with rod 53 inserted between the coils of the spring to keep the spring from buckling when it is compressed. It will be seen that in the normal or rest position of the binding, the force exerted by the spring 51, which is initially compressed by adjustment of sleeve 43, is transmitted by bell crank 47 to cable 31, thereby positioning block 24 with its bearing surfaces 27 and 28 in contact with the longitudinal face 29 of recess 22.

Second arm 49 of bell crank 47 is operatively connected to first arm 46 by means of an auxiliary extension 54 which fits within a longitudinal slot 56 (FIG. 11) in first arm 46 and is fixed for rotation about pin 57. A threaded tension adjusting screw 58 in the side of first arm 46 can be moved inwardly to cause extension 54 to rotate about pin 57 relative to first arm 46, causing the effective lever arm of second arm 49 about pin 48 to increase, and also increasing the degree of compression of spring 51, thus effectively increasing the tension produced in cable 31 by spring 51.

It will be seen that because of the nesting arrangement of block 24 within recess 22 of base plate 11, only a certain limited number of modes of relative motion between the base plate and sole plate 12 is possible. If a lateral force is exerted on the outer edge of sole plate 12 at a point between bearing surfaces 27 and 28, and in an inward direction, i.e., toward face 29 of recess 22, causing both bearing surfaces to remain in contact with face 29, no relative motion of the sole plate and the base plate will be produced regardless of the magnitude of the force applied. If, however, the lateral force is applied to the opposite (i.e., inside) edge of sole plate 12, relative motion between base plate 11 and sole plate 12 can occur, provided the bias exerted by cable 31 is effectively overcome. Similarly, if the lateral force on either side or edge of the ski is applied at a point either in front of forward bearing surface 27 or to the rear of rear bearing surface 28, relative rotation between the sole plate and the base plate can occur.

The configuration shown in FIG. 8 is one which can occur as the result of an outward force applied to the ski at a point forward of block 24, the force tending to produce counterclockwise rotation of the tip of the ski relative to the skier's boot. Under these conditions, block 24 will rotate about its rear bearing surface 28, causing forward bearing surface 27 to move away from contact with face 29 of recess 22. As the relative rotation continues, cable 31, the end of which is affixed to sole plate 12, is extended in opposition to the restoring force exerted by spring 51, which is compressed as the extension of the cable proceeds. It will be seen, however, that because of the position of bell crank 47 and the location of pivot pin 48 about which the bell crank rotates, as the extension of the cable proceeds, the effective lever arm of first arm 46 relative to pivot 48 increases, while the lever arm of second arm 49 decreases. With a given initial force exerted by spring 51, the force necessary to cause continuing separation of sole plate 12 from base plate 11 decreases as the amount of extension increases until the maximum extension of cable 31 is reached, i.e., full release occurs. Accordingly, the restoring force or tension in cable 31 is greatest when the sole plate is in its normal position of alignment with the base plate, before any separation has occured, and decreases with increasing extension of the cable.

This feature contributes a large measure of shock-resisting ability to the binding of the invention. A force of substantial magnitude but of limited duration may cause the sole plate to shift laterally, as shown in FIG. 8, for a sufficient distance to relieve the applied force. When the force is removed, the sole plate will automatically realign itself in normal operative position on the base plate. If the upsetting force continues to be applied, however, the sole plate will continue its relative rotation about the base plate, as long as the applied force exceeds the restoring force exerted by the cable. Since the cable continues to exert some restoring force even at its maximum extension, when the upsetting force is removed the sole plate will automatically be returned to its normal alignment with respect to the base plate, thus facilitating the resumption of skiing after release of the binding has occurred. Further, since at no time is the ski completely disengaged from the skier's boot, there is no necessity for the use of auxiliary bindings or straps for restraining a loose ski, as is customary with conventional bindings.

The displacement shown in FIG. 8 is one produced by a force tending to move the tip of the ski outwardly relative to the skier's boot. In response to a force tending to move the heel of the ski outwardly, an analogous situation would be created. In such case, forward bearing surface 27 of block 24 would remain in contact with face 29 of recess 22, while the rearward bearing surfaces would separate and cable 31 would be extended in the same manner.

Figure 6:
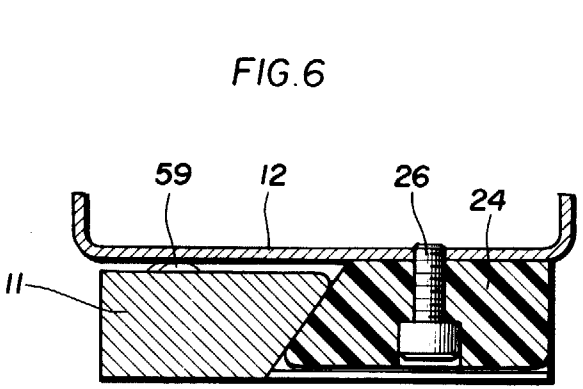
FIG. 6 is a sectional view along the line 6—6 of FIG. 4.
Figure 9:
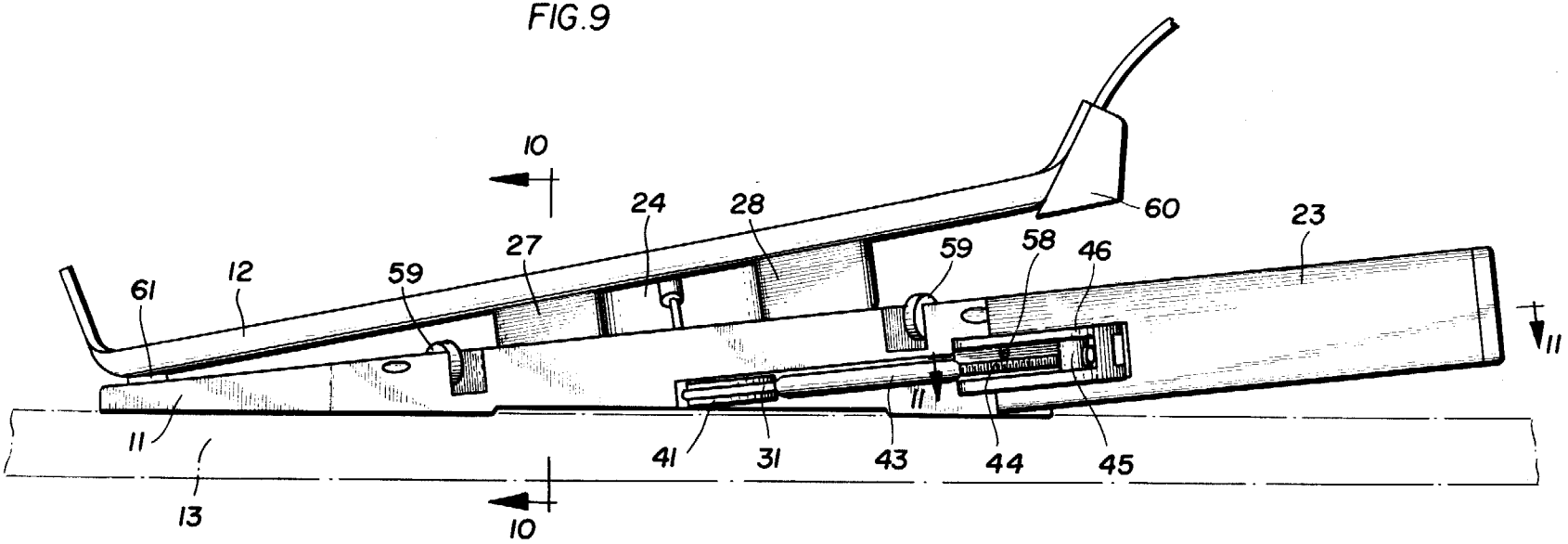
FIG. 9 is a side view of the binding of FIG. 4, showing the manner in which heel release of the sole plate is effected.
Figure 10:
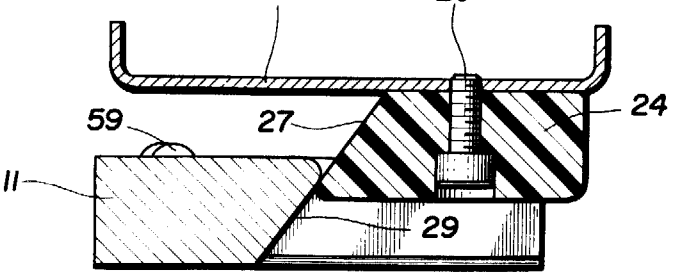
FIG. 10 is a sectional view along line 10—10 of FIG. 9, showing the sole plate in a partially released position.

The safety binding of the invention also operates in response to forces tending to cause the skier's toe or heel to leave the ski in a vertical direction. Since cable 31 is attached to sole plate 12 at an acute angle relative to the top of the ski, the force exerted by the cable has a vertical component which must be overcome to permit vertical separation of the sole plate from base plate 11. In general, in order for a vertical force to present a risk of injury to a skier, its magnitude must be significantly larger than that of a lateral force, which produces a twist or torque. Accordingly, it is desired that the binding not release in a vertical direction except in response to forces larger than those needed to produce lateral release. One way of increasing the vertical release force relative to the horizontal release force is to make the angle which cable 31 makes with the top of the ski larger than 45°, so that the vertical component of the force exerted by the cable exceeds the lateral component thereof. Another way of accomplishing this result, illustrated in the drawings (FIG. 6, 9, and 10) is to form block 24 and the longitudinal face 29 of recess 22 with inclined rather than vertical bearing surfaces, with the bearing surface of block 24 underlying the face 29 of the recess, as shown in FIG. 6. With the arrangement shown in the drawings, in order to achieve vertical release, the displacing force applied must be sufficient to overcome not only the vertical component of the force exerted by cable 31, but also the horizontal component thereof, i.e., the block must move along the contacting surfaces of the edge and block, both vertically and horizontally, as shown in FIGS. 6, 9 and 10. FIGS. 9 and 10 illustrate a partial vertical release of the heel of sole plate 12, with thrust buttons 61 acting as pivots. Under appropriate circumstances, the toe of the sole plate will also release in a similar manner, with thrust block 60 acting as a pivot. It will be seen that in a sole plate of given length the relative magnitude of the forces necessary to produce release at the toe and at the heel of the binding respectively is controlled by the relative distances (i.e. the effective lever arms) from the center of cable 31 to thrust buttons 61 and to thrust block 60 respectively. For example, the force required to produce release at the heel can be decreased (and the force necessary for toe release increased) by decreasing the distance from cable 31 to thrust buttons 61, about which sole plate 12 pivots for heel release, thus reducing the lever arm through which the tension of the cable is applied.

In order to facilitate relative rotation of sole plate 12 and base plate 11 under release conditions, it is desirable that the friction between these two elements be reduced to a minimum. For this purpose, the upper surface of base plate 11 is provided with roller bearings 59, on which the lower surface of sole plate 12 rides. Thrust block 60 and thrust buttons 61 are preferably formed of a low friction material, such as Teflon resin, to minimize friction encountered during lateral release of the binding.

It will be seen that the construction of the safety binding of the invention provides several different modes of release, including lateral inward release of both the toe and heel of the boot but no lateral outward release of either toe or heel. In addition, simultaneous inward release of both heel and toe is permitted, while simultaneous outward release of both heel and toe is prevented. The operating characteristics of the binding of the invention resulting from the aforementioned modes of release are illustrated in FIG. 12.

Figure 12:
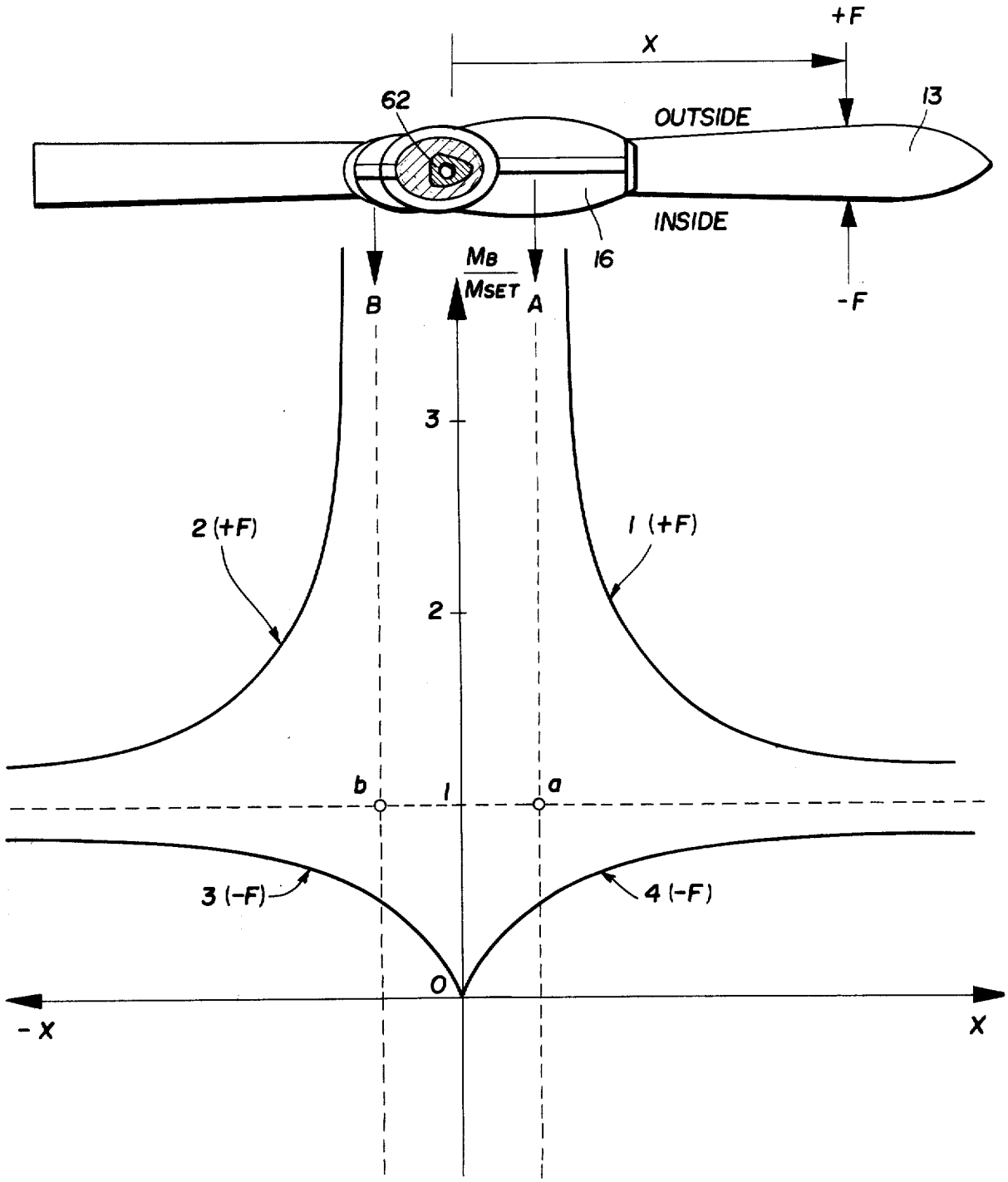

As shown in FIG. 12, plotted beneath a top view of left boot 16 and ski 13, which also shows the tibia 62 of the skier's leg, are curves 1, 2, 3, 4, which represent the torque actually transmitted to the skier's leg ($M_B$) as a ratio of the torque ($M_{set}$) applied to the binding to cause it to release (adjustable by the skier). The distances O-a and O-b represent, respectively, the distances in front of and behind the skier's tibia 62 at which the forward and rearward pivotal axes of the binding are located. The arrows A and B represent inward release of the binding at the toe and heel respectively, outward release being impossible because of the construction of the binding.

A force applied to the outside edge of the ski, tending to create a moment or torque about the skier's leg is depicted as (+F) at a distance X from the tibia; a corresponding force applied to the inside edge of the ski is represented as (−F). The horizontal line passing through the point 1 on the vertical axis represents the value at which the pure torque without side forces exerted on a skier's leg is equal to that which causes the binding to release. Such a condition at release for torque produced by a side force would be obtained if the pivot axis for torque about tibia 12 and the axes about which the binding pivots in its release modes coincided. Since these axes do not coincide, however, the line $M_B/M_{set} = 1$ is an asymptote, which is approached by the release curves as the distance at which the force (+F) or (−F) is applied increases forwardly or rearwardly of the skier's tibia.

In FIG. 12, curve 1 represents the torque exerted on the skier's leg by a lateral force (+F), applied to the outer edge of the ski at a distance X in front of the skier's tibia, the magnitude of the force being sufficient to produce inward release of the heel of the boot, i.e., in direction B. Curve 2 represents the torque exerted on the skier's tibia by a force (+F) applied a distance (−X) behind the skier's tibia, the force producing inward release of the toe of the boot in the direction A. Curve 3 represents the torque applied on the skier's tibia by a force (−F) applied to the inside of the ski at a distance (−X) behind the skier's tibia to produce release at B; curve 4 shows the torque produced on the skier's tibia by a force (−F) at a distance (X) in front of the skier's tibia, to produce release at A.

Consideration of the curves in FIG. 12 shows that on the application of a lateral force to the inside of the ski, depicted by curves 3 and 4, the actual torque exerted on the skier's tibia remains at all times less than the torque which will cause the binding to release at toe or heel. Thus, if the release torque is properly set at a sufficiently low value, the skier's leg is protected against injury due to torque, regardless of where the force is applied to the inside of the ski.

With respect to lateral forces applied to the outside of the ski, it will be seen that the torque exerted on the skier's tibia by such forces when applied at a substantial distance in front of or behind the skier's leg, while larger than the release torque, is only slightly larger and, therefore, the protection afforded the skier remains adequate. As an outside force approaches the skier's boot, however, it will be seen that the torque produced increases rapidly and in the vicinity of $X = a$ or $X = -b$, i.e., when the outside force is applied directly opposite either of the vertical axes about which the binding rotates, the force necessary to produce release becomes infinite, i.e., curves 1 and 2 are asymptotic to the vertical lines $X = a$ and $X = -b$.

FIG. 12 also shows that, with respect to forces applied to the outside of the ski between the forward pivot axis a and the rearward pivot axis *b*, no amount of lateral force will cause the binding to release. While this situation under certain conditions may theoretically present a safety hazard to the skier, in practice it is only rarely encountered because of the design distance separating the pivotal points, because the leg is generally well equipped to withstand lateral outside forces applied in the vicinity of the skier's foot, and because the tendency of the skier is to be thrown over his skis under such loadings.

In summary, the curves of FIG. 12 demonstrate that the binding of the invention provides maximum retention of the skis with respect to forces directed to the outside edges thereof, while maximum safety is offered for forces applied to the inside edges of the skis. In addition, the operation of the bindings is symmetrical with respect to forward and rearward forces relative to the skier's leg, i.e., the binding is equally effective regardless of whether the forces are applied at the tip or at the tail of the ski.

The foregoing detailed description has been given for clearness of understanding only, and no unnecessary limitations should be understood therefrom as modifications will be obvious to those skilled in the art.

What is claimed is:

1. A safety ski binding adapted for securing a ski boot to a ski comprising:

first means operatively connected between said ski and the toe of said boot for holding said toe in alignment with said ski, said first means being releasable in response to an applied predetermined force to permit said toe to move laterally inwardly with respect to said ski, while preventing outward lateral movement of said toe;

second means operatively connected between said ski and the heel of said boot for holding said heel in alignment with said ski, said second means being releasable in response to an applied predetermined force to permit said heel to move laterally inwardly with respect to said ski, while preventing outward lateral movement of said heel; and biasing means for urging said boot into operative contact with said ski.

2. A safety ski binding adapted for securing a ski boot to a ski comprising:

first means operatively connected between said ski and the toe of said boot for holding said toe in operative contact and alignment with said ski, said first means including first pivotal means defining a first generally vertical pivotal axis about which the rearward portion of said boot can pivot;

second means operatively connected between said ski and the heel of said boot for holding said heel in operative contact and alignment with said ski, said second means including second pivotal means defining a second generally vertical pivotal axis longitudinally spaced from said first pivotal axis, about which second axis the forward portion of said boot can pivot;

said first and second pivotal means permitting rotation of the boot about either of said pivotal axes only in a direction toward the inside edge of said ski on the application of a lateral force exceeding a predetermined value.

3. A safety ski binding for securing a ski boot to a ski comprising:

an elongated base plate for attachment to the top surface of said ski;

an elongated sole plate for receiving and holding the sole of said boot, said sole plate overlying said base plate and having two longitudinally spaced generally vertical bearing surfaces depending therefrom and contacting said base plate in two zones of contact which constitute longitudinally spaced generally vertical pivotal axes about either of which said sole plate can rotate with respect to said base plate;

first means for controlling rotation of said sole plate, said first means including a bearing surface in said base plate which cooperates with one of said bearing surfaces in said sole plate to permit rotation about the forward pivotal axis only in a direction to cause lateral inward movement of the heel of said boot and substantially preventing lateral outward movement of said toe;

second means for controlling rotation of said sole plate, said second means including a bearing surface in said base plate which cooperates with the other of said bearing surfaces in said sole plate to permit rotation of said sole plate about the rearward pivotal axis only in a direction to cause lateral inward movement of the toe of said boot and substantially preventing lateral outward movement of said heel; and bias means for urging said sole plate into face-to-face contact with said base plate and said bearing surfaces into mutual lateral contact, said bias means being adjustable to permit relative movement of said base plate and said sole plate when a force tending to cause such movement exceeds a preset value.

4. A ski binding in accordance with claim 3, in which said first and second rotation controlling means comprise an elongated block affixed to and depending from said sole plate, said block nesting in a lateral recess in the inner longitudinal edge of said base plate, said block being in contact with a longitudinal edge of said recess in at least said two bearing surfaces constituting said pivotal axes, whereby rotation about either of said pivotal axes is restricted to one direction only, rotation in the other direction being blocked by contact of the bearing surface constituting the other of said pivotal axes with said longitudinal edge of said recess.

5. The ski binding of claim 4, in which said bias means comprises:

a flexible cable, one end of which is attached to said base plate at a point between the ends of said block; and extensible tensioning means attached to said base plate and operatively connected to the other end of said cable for tensioning said cable to apply a force transverse to the longitudinal axis of said ski at an acute angle with the top surface thereof and in a direction which tends to hold said bearing surfaces in contact with said edge of said recess, said tensioning means producing a maximum force of preset value and being extensible to permit extension of said cable and consequent realtive movement of said sole plate and said base plate in response to a displacing force having a magnitude larger than said preset value;

said tensioning means exerting a restoring force for restoring the contact between said sole plate and said base plate when said displacing force is removed.

6. The ski binding of claim 5 which the force exerted by said tensioning means varies with extension of said cable, being a maximum when no extension of said cable has occurred and decreasing as said cable is extended by increasing separation of said sole plate from said base plate.

7. The ski binding of claim 6 in which said tensioning means includes:

a compressible spring having one end fixed to said base plate; and a two-armed bell crank pivoted to said base plate, one arm of which is connected to said cable and the other arm of which is attached to the other end of said spring in operative position to compress said spring as said cable is extended, said bell crank being so arranged that the effective lever length of the arm tending to compress said spring decreases as said cable is extended, whereby the force necessary to extend said cable decreases as the extension of said cable increases.

8. The ski binding of claim 7 in which said bell crank is provided with means for adjusting the relative lever lengths of its arms, whereby the maximum force necessary to initiate extension of said cable can be adjusted.

9. The ski binding of claim 5 in which said bearing surfaces on said block and the edge of said recess adjacent thereto are inclined upwardly in a direction generally parallel to said cable at its point of attachment to said sole plate, whereby the force required to overcome the tension exerted by said cable and to cause vertical displacement of said sole plate from said base plate exceeds the force required to produce relative lateral displacement thereof.

10. The ski binding of claim 9, in which the distance between said longitudinally spaced bearing surfaces is about 20–80 percent of the length of said sole plate.

11. The ski binding of claim 3, which is provided with low friction means located between said sole plate and said base plate for reducing the sliding friction therebetween during relative lateral movement thereof.

12. The ski binding of claim 11, in which said low friction means includes roller bearings mounted in said base plate and in contact with said sole plate.

13. The ski binding of claim 3, in which the effective thickness of said base plate varies from a maximum at the heel end to a minimum at the toe end, whereby said binding imparts a forward lean to a boot attached thereto.

14. A safety ski binding for holding a ski boot in alignment with a ski comprising:

an elongated base plate for attachment to the top surface of a ski in alignment with the longitudinal axis thereof, said base plate having a lateral recess, the inner longitudinal edge of which is provided with a pair of longitudinally spaced upwardly inclined bearing surfaces;

an elongated sole plate overlying said base plate, said sole plate having means for receiving and holding the sole of a ski boot;

block means attached to the underside of said sole plate and having a configuration adapted to fit within the lateral recess of said sole plate, said block means having inclined surfaces adapted to underlie and contact said upwardly inclined bearing surfaces in said base plate, the zones of contact therebetween constituting longitudinally spaced generally vertical pivotal axes about which said sole plate can rotate relative to said base plate, rotation about the forward pivotal axis being limited to a direction which causes inward movement of the heel of said boot, and rotation about the rearward pivotal axis being limited to a direction which causes inward movement of the toe of said boot;

bias means including a flexible cable, one end of which is attached to said block means at a point between its ends, said cable being tensioned to apply a force transverse to the longitudinal axis of said base plate at an acute angle with the top surface thereof, in a direction which tends to hold said sole plate in contact with said base plate and said block means in contact with the bearing surfaces of said recess; and tensioning means including a two-armed bell crank and a coil spring for creating a tension in said cable while permitting extension thereof, one arm of said bell crank being operatively connected to the other end of said cable and the other arm being operatively connected to said spring in a manner which causes the tension created in said cable by said spring to decrease as the cable is extended.

15. The binding of claim 14 in which the bellcrank includes means for adjusting the relative effective lengths of the arms of said bell crank, whereby the force exerted by said tensioning means can be controlled.

* * * * *